United States Patent [19]

Sullivan et al.

[11] Patent Number: 5,033,745

[45] Date of Patent: Jul. 23, 1991

[54] GOLF CHIPPING PRACTICE APPARATUS

[76] Inventors: Bruce J. Sullivan, 275 N. Lotus Beach Dr., Portland, Oreg. 97217; Scott J. Sullivan, 1510 NE. 45th #2, Portland, Oreg. 97213

[21] Appl. No.: 539,734

[22] Filed: Jun. 18, 1990

[51] Int. Cl.[5] ..... A63B 69/36

[52] U.S. Cl. ..... 273/184 R; 273/182 R; 273/183 R; 273/184 A

[58] Field of Search ..... 273/176 R, 176 B, 176 A, 273/181 R, 182 R, 182 A, 35 R, 35 B, 183 R, 184 R, 184 A, 185 R

[56] References Cited

U.S. PATENT DOCUMENTS

| | | | |
|---|---|---|---|
| D. 83,498 | 3/1931 | Carter . | |
| D. 234,526 | 3/1975 | Zawacki | D21/2 |
| D. 239,299 | 3/1976 | O'Shea | D21/1 |
| 2,229,382 | 1/1941 | Irwin et al. | 273/182 R |
| 3,011,791 | 12/1961 | Page | 273/183 R X |
| 3,104,879 | 9/1963 | Jetton | 273/184 R X |
| 3,826,501 | 7/1974 | Hiromachi | 273/176 A |
| 3,877,704 | 4/1975 | Bayley | 273/176 A |
| 3,917,279 | 11/1975 | Barber | 273/184 R X |
| 4,018,436 | 4/1977 | Leigh | 273/35 B |
| 4,171,812 | 10/1979 | Marsin | 273/182 R X |
| 4,281,834 | 8/1981 | Chavez | 273/182 R |
| 4,336,939 | 6/1982 | Krumlauf | 273/185 R |
| 4,828,267 | 5/1989 | Goodrich | 273/182 R X |

*Primary Examiner*—William H. Grieb

*Attorney, Agent, or Firm*—Kolisch, Hartwell, Dickinson

[57] ABSTRACT

A golf chipping practice apparatus is provided which includes a plurality of separate panels onto which balls are chipped. Each panel is divided into a plurality of target zones, including target holes. A plurality of sensors automatically detect where a ball lands and an automated scorekeeping device assigns a scoring value to each shot based on where it lands. The scorekeeping device generates a total score and determines when a round has been completed, based on a predetermined number of balls having landed on each panel. A golf chipping practice game suitable for the apparatus is also disclosed.

16 Claims, 3 Drawing Sheets

GOLF CHIPPING PRACTICE APPARATUS

BACKGROUND AND SUMMARY OF THE INVENTION

The invention relates to golf practice devices and in particular to a golf practice apparatus directed to chipping a ball onto a target area as part of a practice game suitable for indoor or outdoor use.

Golf practice devices suitable for indoor or outdoor use have been designed to test and improve a golfer's technique. Some of the practice devices function as indoor driving ranges. Others, such as miniature golf courses, function as putting ranges. Still others provide a chip and putt game, such as that shown in U.S. Pat. No. 4,336,939. U.S. Pat. No. 3,826,501 simulates a driving range, bunkers, greens, etc. Other patents disclosing various types of golf games or practice devices include U.S. Pat. Nos. Des. 83,498, Des. 234,526, Des. 239,299 and 4,018,436.

Chip shots are a particularly challenging part of the game of golf. As with other shots in golf, a player can improve his or her game by chipping with a high degree of accuracy. It would be advantageous to have a golf practice apparatus which is both challenging and interesting to the user and helps improve the accuracy of a golfer's chip shots.

It is therefore an object of the present invention to provide a golf chipping practice apparatus which is relatively compact and thus suitable for indoor or outdoor use and which provides simulated chipping practice for the user.

It is a further object of the invention to provide a golf chipping practice apparatus on which a challenging and interesting golf chipping game is played, the game being suitable for individual play as well as match play against an opponent.

Accordingly, a golf chipping practice apparatus is provided for use by a player who is positioned in a ball hitting area of the apparatus. The apparatus comprises a ball receiving area onto which balls are chipped. The ball receiving area is divided into a plurality of target zones and further includes a plurality of regions, each of which encompasses a predetermined number of the target zones. A plurality of sensors are provided in the ball receiving area for detecting which target zone a ball lands in. And a scorekeeping device is provided which is responsive to the sensors for determining the target zone a ball lands in. The scorekeeping device also, simultaneously, counts the number of balls landing in each region of the ball receiving area. As such, both the target zone information and the number of balls landing in each region are available for scoring a game.

In the embodiment described below, the scorekeeping device automatically records both a total score, based on the target zones balls land in, and a count of the number of balls landing in each region of the ball receiving area. A round or game is completed when a predetermined number of balls have been chipped into each region of the ball receiving area.

The apparatus described below comprises a plurality of panels supported forward of the ball hitting area at which the player aims chip shots. Each panel forms one region of the ball receiving area of the apparatus. A plurality of target zones are provided on each of the panels. A plurality of sensors associated with each of the panels are used to detect the target zone a ball has landed on. The scorekeeping device generates and maintains a total score for each round of play.

Additional features of the preferred scorekeeping system of the invention include a device for accumulating a panel count for each panel, the panel count equalling the total number of balls landing on each panel. The panel count, which is used to determine the end of a round of play, is independent of the total score maintained by the scorekeeping device. The game played on the apparatus of the present invention is structured to challenge a golfer/user to direct chip shots to each of the aforementioned panels at least a predetermined minimum number of times as measured by the panel count. Aiming skill is tested by penalizing the player who hits more shots than the minimum required on any given panel, the penalty being the accumulation of additional total score for each extra shot taken. As in regular golf, a lower total score is desirable.

In the preferred embodiment, the invention incorporates three separate panels, termed Par 3, Par 4 and Par 5, and at least five target zones on each panel, termed eagle, birdie, par, bogey and double bogey (in order of ascending scoring value). The scorekeeping device accumulates the total score for each player or each game round and requires the player to aim for and hit several different targets throughout the course of a game. The player shooting the round with the lowest scoring value wins. Thus, the game encourages players to chip with high accuracy.

DETAILED DESCRIPTION OF THE PREFERRED EMBODIMENT

Figures 1, 2:
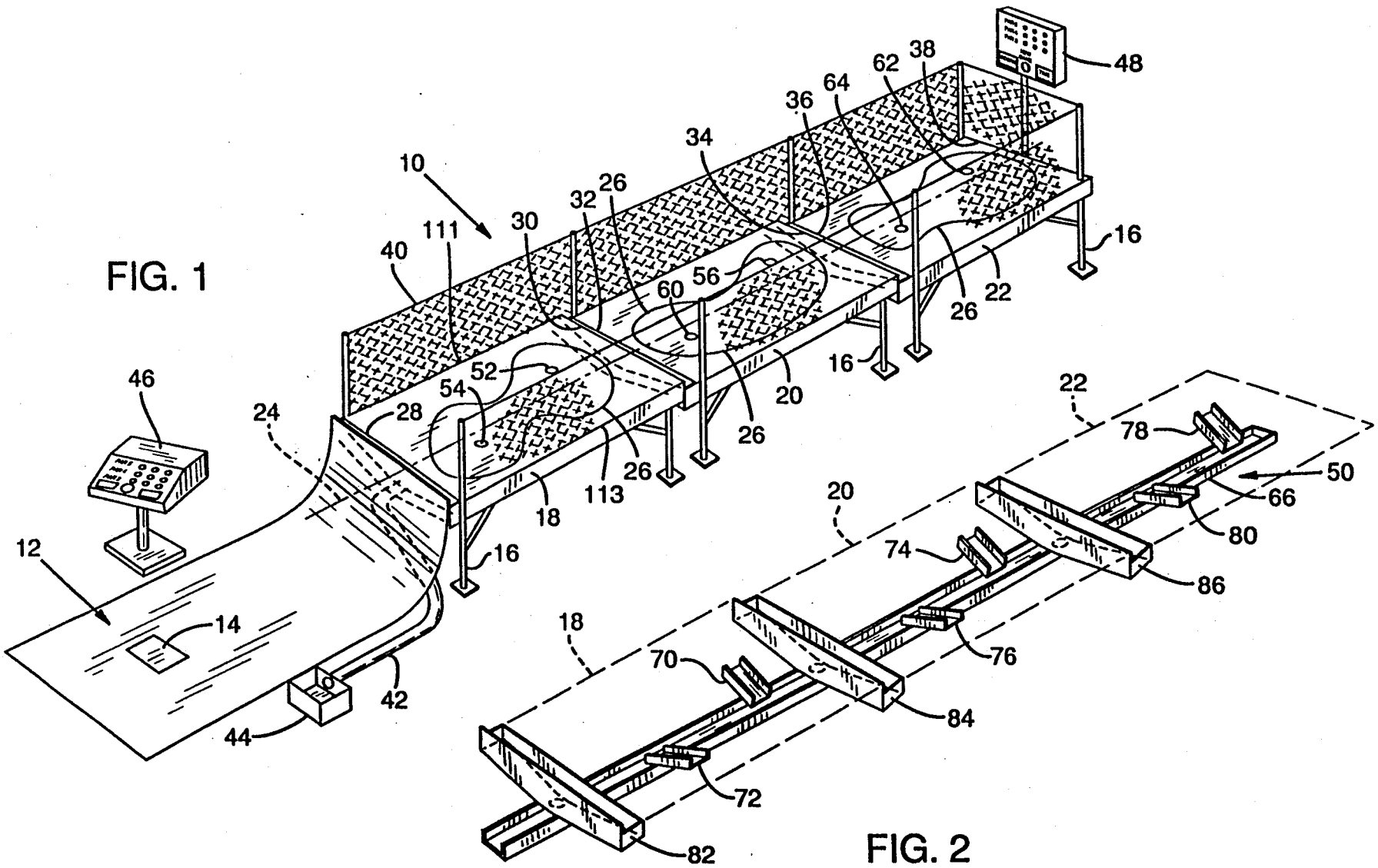
FIG. 1 is a partially schematic perspective view of the golf chipping practice apparatus of the present invention.
FIG. 2 is a partial, perspective view of the ball return system used in the apparatus of FIG. 1, including the ball return channels located at the lower forward edge of each panel.

Referring to FIG. 1, a golf chipping practice apparatus 10 is provided in accordance with the present invention. Apparatus 10 includes a ball hitting area 12 where a player stands when using the apparatus. A golf ball is positioned on a teeing pad 14 formed, for example, of artificial grass or another suitable material, to stimulate conditions from which chip shots are made. A frame 16 supports a plurality of panels 18, 20 and 22 in a ball receiving region forward of the ball hitting area 12. The ball receiving region means the region toward which a player chips a ball. In the apparatus of the present invention the ball receiving region is the surface area of panels 18, 20, 22, which are raised on frame 16 above ball hitting area 12. Panels 18, 20, 22 are preferably each 8-feet by 8-feet in size.

Panels 18, 20 and 22 are generally rectangular in shape, solidly constructed of plywood or the like and arranged on frame 16 generally co-linearly, one after another, along a longitudinal axis 24. The longitudinal axis extends generally along the centerline of each panel and through or above the teeing pad 14 of ball hitting area 12. Frame 16 may conveniently be formed in separate sections, one for each panel 18, 20, 22, and may be fabricated to collapse for portability, if desired.

The top surface of each panel 18, 20, 22 is covered with artificial turf, carpeting, or another material which simulates a green on a golf course. The appearance of the surface of each panel can be enhanced by markings 26 in the shape of simulated greens or the like.

Each of the panels 18, 20, 22 is supported on frame 16 inclined from the horizontal generally toward ball hitting area 12. Thus, the near edge 28 of panel 18 is lower than the far edge 30, so that a ball landing on panel 18 will tend to roll toward ball hitting area 12. Similarly, near edge 32 of panel 20 is lower than far edge 34 and near edge 36 of panel 22 is lower than far edge 38. The panels are supported at gradually ascending elevations, with the rear or most distant panel 22 (measured from ball hitting area 12) at a higher overall elevation than the others and the panel 18 closest to the ball hitting area at a lower elevation than the others. Each panel may alternatively be supported on frame 16 at approximately the same average level as the other panels, if desired. The incline or pitch of each individual panel may also vary from one to another, for example, increasing with distance from the ball hitting area.

The panels are supported spaced-apart from one another. For example, far edge 30 of panel 18 is spaced-apart from near edge 32 of adjacent panel 20. The adjacent edges 30 and 32 of adjacent panels are also at different levels, with far edge 30 of panel 18 supported at a higher level than near edge 32 of adjacent panel 20. Likewise, far edge 34 of panel 20 is spaced-apart from near edge 36 of adjacent panel 22 and edge 34 is at a higher level than edge 36. The panel surfaces thus form a broken saw-tooth type of pattern. The spacing and different levels of the panel edges help prevent golf balls landing on one panel from rolling down onto the adjacent panel.

Side screens or netting 40, supported on frame 16, extends above panels 18, 20, 22 along their respective side edges. The netting is somewhat schematic, as shown in FIG. 1, and in actual installation might extend outwardly at an angle from the side edges of the panels and at the far end of the apparatus in order to catch balls which miss the panels entirely. Alternatively, netting 40 might be eliminated altogether in installations where panels 18, 20, 22 are surrounded by walls or curtains supported by an enclosing structure (not shown). It will be appreciated by those skilled in the art that netting 40 is designed to collect or confine stray balls.

A ball return system, described in greater detail below, is partially indicated in FIG. 1 by a ball return chute 42 and collection tray 44 adjacent ball hitting area 12. Balls hit onto panels 18, 20, 22 are returned via the ball return system to tray 44, preferably by gravity, in order to facilitate continuous play by the user. A scorekeeping stand 46 is provided adjacent ball hitting area 12 and includes scoring displays and necessary switches or other means for turning on and off or resetting the apparatus from a location adjacent the ball hitting area. An additional score board 48 can be installed at the far end of the apparatus, if desired.

Each panel 18, 20, 22 includes on its upper surface one or more holes, 3-to 4-inches in diameter, which extend through the panels and serve as targets for the chipping game played with the apparatus. Panel 18 includes holes 52 and 54. Hole 52 on panel 18 is farthest from ball hitting area 12 and 3-inches in diameter and hole 54 is closest to ball hitting area 12 and 4-inches in diameter. Panel 20 includes holes 56 and 60. Hole 56 on panel 20 is farthest from ball hitting area 12 and 3-inches in diameter and hole 60 is closest to ball hitting area 12 and 4-inches in diameter. Panel 22 includes holes 62 and 64. Hole 62 on panel 22 is farthest from ball hitting area 12 and 3-inches in diameter and hole 64 is closest to ball hitting area 12 and 4-inches in diameter.

FIG. 2 shows parts of the ball return system supported beneath panels 18, 20, 22, the panels being outlined in phantom. Ball return system 50 includes a series of channels, tubes, gutters, troughs or the like which convey and return by gravity balls to ball hitting area 12 from panels 18, 20 or 22. Balls enter ball return system 50 through various means which include sensors incorporated into the scoring system of the present invention, as described below.

Ball return system 50 includes a central elongated longitudinal gutter 66 extending lengthwise beneath each of the panels 18, 20 and 22, generally along and parallel to longitudinal axis 24. In the preferred embodiment of the golf chipping apparatus, target holes 52, 54, 56, 60, 62 and 64, which are designed to receive balls therein, are all slightly offset from the central longitudinal axis 24 of the apparatus. Consequently, short side gutters extend perpendicularly from central gutter 66 and balls passing through the holes drop into the side gutters. The side gutters generally extend transverse to the direction of longitudinal axis 24 a distance necessary to intercept and collect balls falling through the target holes. Under panel 18, side gutter 70 extends beneath hole 52 and side gutter 72 extends beneath hole 54. Under panel 20, side gutter 74 extends beneath hole 56 and side gutter 76 extends beneath hole 60. Under panel 22, side gutter 78 extends beneath hole 62 and side gutter 80 extends beneath hole 64.

An additional system which feeds balls into central gutter 66 includes three ball return channels, one associated with each of the panels 18, 20 and 22. Each of the ball return channels extends along at least one edge of each of the panels, that edge being the lowest edge, in order to catch and collect balls from the panel. Each of the panels is inclined generally in the direction of the ball return channel associated with that panel. The arrangement cf panels is such that a ball landing on any of the target panels of the apparatus 18, 20, 22 will be directed, by the incline of the respective panel on which the ball lands, into one of the ball return channels 82, 84, 86.

Ball return channel 82 extends generally perpendicularly to longitudinal axis 24, along edge 28 of panel 18, the lower edge of the panel closest to ball hitting area 12. Channel 82 extends the length of edge 28 in order to catch all balls which land on panel 18, except for the balls which enter holes 52 and 54.

Ball return channel 84 extends generally perpendicularly to longitudinal axis 24 along edge 32 of panel 20, the lower edge of the panel closest to ball hitting area 12. Channel 84 extends the length of edge 32, in order to catch all balls which land on panel 20, except for the balls which enter holes 56 and 60.

Ball return channel 86 extends generally perpendicularly to longitudinal axis 24 along edge 36 of panel 22, the lower edge of the panel closest to ball hitting area 12. Channel 86 extends the length of edge 36 in order to catch all balls which land on panel 22, except for the balls which enter holes 62 and 64.

Figure 3:
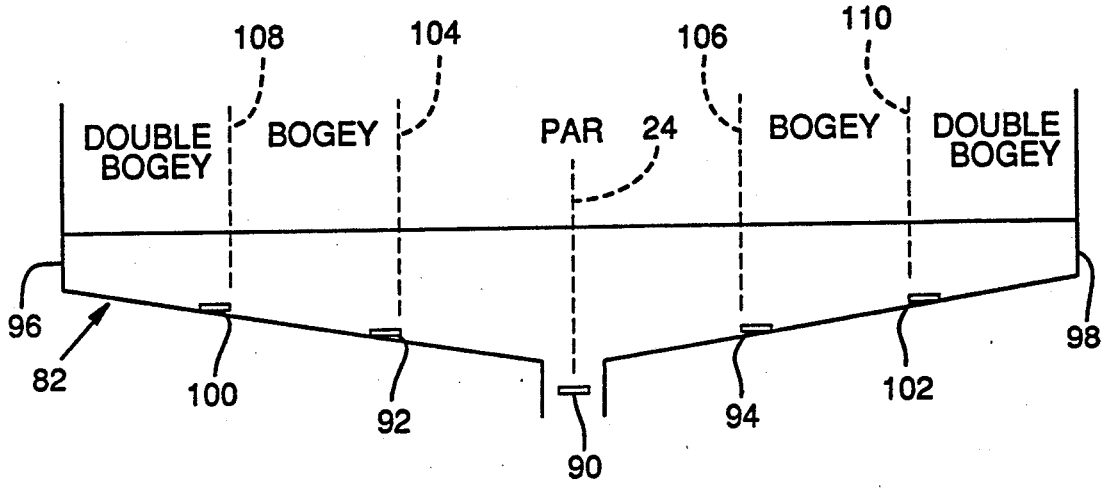
FIG. 3 is a side cross-sectional view of one ball return channel as shown in FIG. 2, including schematic representations of several ball location sensors and a schematic depiction of selected target zones.

Referring to FIGS. 1, 2 and 3, a plurality of sensors are positioned at selected locations throughout the apparatus for the purpose of detecting or sensing where balls land on the apparatus. The sensors are located within ball return channels 82, 84 and 86 and within target holes 52, 54, 56, 60, 62 and 64. An alternative location for the sensors associated with each target hole on the apparatus is to locate the sensors in the short branch gutters 70, 72, 74, 76, 78 and 80 which extend beneath the holes. Each sensor is a pressure-sensitive switch of any conventional type which closes an electrical circuit when a ball passes over the switch. Other types of sensors designed to detect the passage of a golf ball over the sensor may alternatively be used. The arrangement of sensors on the apparatus, and the processing of the electrical signals received from the sensors, establishes the scoring system of a golf practice chipping game played on the apparatus.

Before defining the location of the sensors, a description will be provided of the overall object of the golf chipping practice game. The ball receiving area of the apparatus is divided into a plurality of separate regions for scorekeeping purposes. In the apparatus shown, three regions are provided in the form of the three panels 18, 20, 22. The panels are subdivided into a pattern of target zones which are assigned different scoring values. For example, each of the holes 52, 54, 56, 60, 62 and 64 is a target zone. Like in regular golf, balls which are chipped directly into or roll into a hole receive a favorable score. Balls which land on panels 18, 20 and 22 and do not enter any of the holes are assigned scores based on how close the ball lands to the center line of each panel.

The center line of each panel is generally at or near the longitudinal axis 24 of the apparatus. Balls landing closer to the center line receive more favorable scoring than balls landing farther away from the center line. Thus, the game is designed to favor accurate aiming of chip shots onto the panels by rewarding players whose balls land closest to the center of the panels, with the greatest scoring rewards given to shots which cause the ball to enter one of the holes.

The plurality of sensors positioned at various locations on the apparatus serve as a means for detecting which target zones a ball lands in each of the target zones of the apparatus. The sensors associated with each target hole, described above, detect the balls which enter the target zones formed by the holes. In order to detect the location of balls which land on the panels but do not enter one of the holes, a series of sensors is located in each of the ball return channels 82, 84, 86.

FIG. 3 shows ball return channel 82 in cross-section. Channel 82 is representative of the other ball return channels 84, 86. Channel 82 slopes downward toward the center of the channel, causing balls entering the channel at any point to roll toward the center, after which the ball passes into central gutter 66 for return to tray 44 in the ball hitting area 12. A first sensor 90 is located in the center of ball return channel 82, to detect all balls exiting the ball return channel into gutter 66.

A pair of additional sensors 92, 94 are located on the bottom of ball return channel 82, spaced a predetermined distance outwardly from the center of channel 82. Sensors 92 and 94 define target zone boundaries on opposite sides of the sensors. Balls which enter channel 82 in the region above sensor 92, to the left of sensor 92 as viewed in FIG. 3, will roll downhill over sensor 92 as they pass by gravity to the center of channel 82 and exit the channel. Balls which enter channel 82 below sensor 92, to the right of the sensor as viewed in FIG. 3, do not pass over sensor 92 as they exit the channel. Thus, sensor 92 establishes a zone boundary for balls entering the channel. Balls which enter the channel between sensor 92 and the left edge of channel 82 (as viewed in FIG. 3), at 96, will trip or energize sensor 92 (in addition to other sensors). Such balls will also trip sensor 90 as they exit the channel. Balls which enter channel 82 below or to the right of sensor 92 trip only sensor 90. Similarly, sensor 94 establishes a zone boundary for balls entering channel 82 above sensor 94, between sensor 94 and end wall 98. Such balls will trip sensor 94 as they roll downhill toward the center of the channel. Such balls will also trip sensor 90 as they exit the channel. Balls which enter the channel 82 below or to the left of sensor 94 will only trip sensor 90.

Two additional sensors, 100 and 102, are positioned in the bottom of channel 82. Sensor 100 is located a predetermined distance from the center of channel 82, between sensor 92 and the left edge 96 of channel 82, as viewed in FIG. 3. Sensor 100 forms a target zone boundary between balls which enter channel 82 in the region above sensor 100, to the left of sensor 100 as viewed in FIG. 3, and balls which enter channel 82 below sensor 100, to the right of sensor 100. Balls which enter the channel above sensor 100 will trip or energize sensor 100, followed by sensor 92, followed by sensor 90, before exiting the channel.

Sensor 102 is located a predetermined distance from the center of channel 82, between sensor 94 and the right edge 98 of channel 82. Sensor 102 defines a target zone boundary between balls which enter channel 82 in the region above sensor 102, to the right of sensor 102 as viewed in FIG. 3, and balls which enter channel 82 below sensor 102, to the left of sensor 102. Balls which enter channel 82 above sensor 102 will trip or energize sensor 102, followed by sensor 94, followed by sensor 90, before exiting the channel.

Sensors 90, 92, 94, 100 and 102 together define target zones on the adjacent panel above the ball return channel For channel 82, the adjacent panel associated with the ball return channel is panel 18. Balls which land on panel 18, except those which enter holes 52 or 54, roll downward into ball return channel 82 in one or another of the various zones established by sensors 90, 92, 94, 100 and 102. Referring to FIG. 3, the various target zones associated with panel 18, extending above ball return channel 82, are defined by the golfing terms par, bogey and double bogey.

The central target zone, extending along and on either side of the central longitudinal axis 24 of panel 18, is the par zone. The outer boundaries of the central or par target zone are defined by sensors 92 and 94 in channel 82. Balls landing within the par zone will roll down inclined panel 18 and fall into channel 82 in the region between sensors 92 and 94, tripping sensor 90 but not sensors 92 and 94 as the balls exit the channel. A ball which trips sensor 90 without tripping any of the other sensors in channel 82 will receive a "par" scoring value for the shot.

The region just outside the par target zone on panel 18 includes two parallel bogey target zones. The divisions between the par and bogey zones are indicated in FIG. 3 by zone boundary lines 104 and 106, extending above channel 82 onto adjacent panel 18, which is represented schematically in FIG. 3. The zone boundaries, which for panel 18 are also shown in FIG. 1, extend generally parallel to the central longitudinal axis of panel 18, between lower edge 28 and top edge 30. Balls landing in the region outside zone boundaries 104 and 106 will roll down panel 18 and drop into channel 82 above sensors 92 or 94, tripping one or the other of those sensors as they pass to the center of the channel. The balls subsequently will also trip central sensor 90 as they exit channel 82. Any ball which trips either sensor 92 or sensor 94 but not sensors 100 or 102, will receive a "bogey" scoring value for the shot.

The pair of regions located outward from the bogey zones, the outermost regions on panel 18, are a pair of parallel double bogey target zones. The division between the bogey and double bogey zones are indicated in FIG. 3 by zone boundary lines 108 and 110, extending above channel 82 onto panel 18. Those zone boundaries, also shown in FIG. 1, extend generally parallel to the central longitudinal axis 24 of panel 18, between lower edge 28 and top edge 30. Balls landing in the double bogey zones, between zone boundary 108 and edge 111 (FIG. 1) and between zone boundary 110 and edge 113, will drop into channel 82 above either sensor 100 or sensor 102. Balls passing over sensor 100 will subsequently trip sensors 92 and 90 as they exit channel 82. Balls passing over sensor 102 will subsequently trip sensors 94 and 90 as they exit channel 82. Any ball which trips either sensor 100 or sensor 102 will receive a "double bogey" scoring value for the shot.

Zone dividing lines 104, 106, 108 and 110 need not be indicated physically or by markings on the upper surface of panel 18, or the other panels, as players will quickly become aware of the approximate dividing lines of the regions. The sensors in ball return channel 82, in effect, define the target zone boundaries 104, 106, 108 and 110. A ball landing in one of the target zones, assuming it does not enter either hole 52 or hole 54, will eventually roll down into ball return channel 82 and trip the sensor or sensors associated with the target zone in which the ball landed As such, each target zone on a panel is defined as that part of the panel which directs balls to the sensor for the target zone. The double bogey zones on panel 18 are the areas of the panel which direct balls to either sensor 100 or sensor 102. The bogey zones on the panel are the areas which direct balls to either sensor 92 or sensor 94, without tripping sensors 100 and 102. The par zone is that area of panel 18 which directs balls landing on the panel to sensor 90, without tripping any of the other sensors in channel 82.

Ball return channel 84 includes sensors arranged exactly like those shown and described with reference to FIG. 3. Channel 84 defines target zones on panel 20 like those described above with reference to panel 18. Using the same reference numbers from FIGS. 1 and 3 for the zone boundary lines, panel 20 includes a par zone extending longitudinally down the center of panel 20 between zone boundaries 104 and 106. Panel 20 also includes a pair of parallel bogey zones between boundaries 108 and 104 on one side of the par zone and between boundaries 106 and 110 on the other side of the par zone. Panel 20 further includes a pair of parallel double bogey zones lying outside zone boundaries 108 and 110.

Ball return channel 86 includes sensors exactly like those shown in FIG. 3. Channel 86 defines target zones on panel 22 like those described above with reference to panel 18. Using the same reference numbers from FIGS. 1 and 3 for the zone boundary lines, panel 22 includes a par zone extending longitudinally down the center of panel 20 between zone boundaries 104 and 106. Panel 22 also includes a pair of parallel bogey zones between boundaries 108 and 104 on one side of the par zone and between boundaries 106 and 110 on the other side of the par zone. Panel 22 further includes a pair of parallel double bogey zones lying outside zone boundaries 108 and 110.

Thus, a plurality of sensors associated with each panel 18, 20, 22 serve as a means for detecting when a ball has landed on each individual target zone on each panel. A ball landing anywhere on any panel, or even a ball landing directly in one of the ball return channels 82, 84 and 86, lands in a target zone of one scoring value or another. The sensors in channels 82, 84 and 86, and in each of the target holes, together form a means for detecting a ball landing on each of the target zones of the apparatus.

The apparatus also includes a scorekeeping device responsive to the sensors for determining the target zone a ball lands in. From the information about the target zone a ball lands in, a scoring value can be assigned to the shot. The conversion of electrical signals received from the various sensors on the apparatus into a score for the golf chipping game associated with the apparatus is described with reference to FIGS. 4 and 5.

Figure 4:
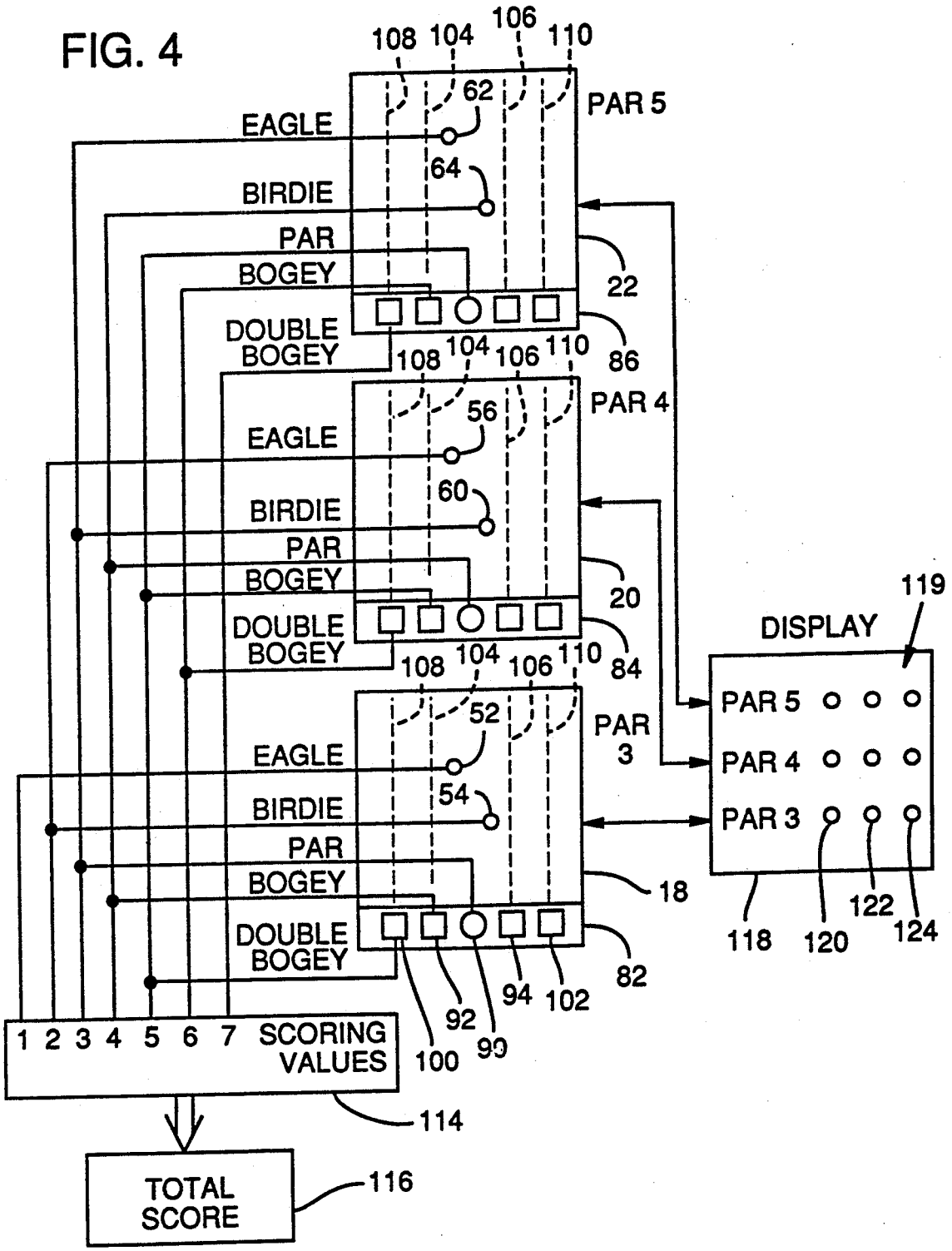
FIG. 4 is a schematic circuit and scoring diagram showing the interrelationship between the target zones on the various panels and the scorekeeping system.

Referring to FIG. 4, a schematic representative of a scoring system is shown for a golf chipping practice game played on the apparatus of the present invention. Rectangles 18, 20 and 22 correspond to the three panels shown in FIG. 1, viewed from above. The panels are arbitrarily assigned a par number associated with the distance of the panel from the golfer. Panel 18 is designated the Par 3 panel, panel 20 is designated the Par 4 panel and panel 22 is designated the Par 5 panel. The target zones on each panel described above with reference to FIGS. 1 and 2 are depicted schematically in FIG. 4.

Panel 18 includes the two holes 52, 54, which are called eagle and birdie target zones, plus the three target zones, par, bogey and double bogey, discussed above with reference to FIG. 3. Ball return channel 82 at the bottom of panel 18 is depicted as a series of rectangles and a central circle along the bottom edge of the panel. The rectangles are schematic representations of sensors 92, 94, 100 and 102 for detecting the passage of golf balls at different locations in ball return channel 82. The circle 90 corresponds to the sensor at the base of ball return channel 82, where a ball exits the channel and enters central gutter 66 (FIG. 2). Rectangle 18 thus schematically represents the various target divisions or zones of one region of the ball receiving area of the apparatus, namely, panel 18.

Limiting the discussion initially to Par 3 panel 18, the scoring values assigned to the various target zones on the panel are schematically depicted in box 114. The scoring values are used in the scorekeeping system described below. The lowest and thus most favorable score earned by a ball landing on panel 18 is assigned to hole 52. Hole 52 is termed the eagle hole, which in golf is two strokes under par. On a par 3 hole in regulation golf, an eagle is a hole-in-one. Therefore, on Par 3 panel 18, a ball which enters hole 52 is an eagle and receives a scoring value of one.

The next best score for a ball landing on panel 18 is assigned to hole 54. Hole 54 is termed the birdie hole, which in regulation golf is one under par. On a Par 3 hole in regulation golf, a birdie is two strokes. Thus, on panel 18, the birdie hole 54 is assigned a scoring value of two.

The next best shot on panel 18 is a par. A par is earned when a ball lands in the band between zone boundaries 104 and 106 on panel 18 and does not go into holes 52, 54. As described above with reference to FIG. 3, the par target zone is the region on panel 18 where balls fall or roll into ball return channel 82 without tripping sensors 92 or 94. A ball landing in the par target zone on panel 18 receives a scoring value of three, or par.

The next best score for a ball landing on panel 18 is a bogey. The target zone for a bogey score lies between zone boundaries 104 and 108 and between zone boundaries 106 and 110. In regulation golf a bogey is one stroke over par, which on Par 3 panel 18 receives a scoring value of four. The bogey target zones are the regions on panel 18 where balls fall or roll into ball return channel 82 and trip sensors 92 or 94, plus sensor 90, without tripping sensors 100 or 102.

The next best score, which in the game described is also the worst score, is assigned to the target zones furthest from longitudinal axis 24, to the left of zone boundary 108 and to the right of zone boundary 110. Those zones, lying outside boundaries 108 and 110, are termed the double bogey zones. In regulation golf, a double bogey is two strokes over par. On Par 3 panel 18, balls landing in the double bogey zones receive a scoring value of five. The double bogey zones are the regions on panel 18 where balls fall or roll into ball return channel 82 and trip either sensor 100 or sensor 102.

The scoring values assigned to the various target zones on panel 18 are depicted schematically in FIG. 4 by the lines, identified as the eagle, birdie, par, bogey and double bogey lines, drawn between selected sensors and scoring value box 114. The eagle line connects hole 52 with a scoring value of one. The birdie line connects hole 54 with the scoring value two. The par line connects sensor 90, the sensor associated with the par target zone, with scoring value three. The bogey line connects sensor 92, the sensor for one of the bogey target zones, with scoring value four. The double bogey line connects sensor 100, the sensor for one of the double bogey target zones, with scoring value five. Similar lines are drawn to the predetermined scoring values associated with the target zones on panels 20 and 22.

Panel 20, which is the Par 4 panel, is divided into target zones like those on panel 18, but the scoring values assigned to the various target zones are appropriate for a par 4 hole, rather than a par 3 hole. Accordingly, balls which enter eagle hole 56 receive a scoring value of two under par, which on a par 4 hole in regulation golf is two. Balls entering birdie hole 60 receive a scoring value of one under par, which on a par 4 hole in regulation golf is three. Balls landing in the par target zone, between zone boundaries 104 and 106, receive a par scoring value, or four. Balls landing in the bogey target zones, between zone boundaries 104 and 108 or between zone boundaries 106 and 110, receive a bogey score, which on a par 4 hole in regulation golf is five. Balls landing in the double bogey zones, to the left of zone boundary 108 or to the right of zone boundary 110, receive a double bogey score, which on a par 4 in regulation golf is six.

For panel 22, which is the par 5 panel, balls landing on the panel which enter hole 62 are assigned an eagle score, which on par 5 panel 22 is a three. Balls entering hole 64 are assigned a birdie score, which on par 5 panel 22 is a four. Balls landing within the par zone, between dashed lines 104 and 106, receive a par score, or five. Balls landing in the target zone outside lines 104, 106 and inside lines 108, 110 receive a bogey, or a six. Balls landing outside lines 108, 110 receive a double bogey, or a scoring value of seven.

The scoring values assigned to each of the target zones on each panel are used to compute the total score for a game played on the apparatus. That score is depicted schematically in FIG. 4 as box 116. The sensors, which are part of the scorekeeping device of the apparatus, indicate which target zone a ball lands in and, from that information, a total score is accumulated based on the predetermined scoring values assigned to the target zones.

A second scorekeeping function performed simultaneously by the apparatus of the present invention is to accumulate a total count of the number of times a ball lands on each of the regions of the ball receiving area. In the preferred embodiment, each such region is one of the three panels 18, 20, 22. The counting of the number of balls landing on each panel is termed the panel count. Both the total score from box 126 and the panel count are used to score the game played on the apparatus.

The total number of balls landing on each panel is recorded, up to a predetermined maximum panel count for each panel, by a display box or display device depicted schematically in FIG. 4 as box 118. The panel count is maintained by display device 118 using a pattern of lights 119 set in rows and columns. When a ball lands on a panel, the panel count for that panel increases by one. Display device 118 records and displays the panel count for each panel by illuminating a lamp in the row of lamps adjacent the panel identifier, which for panel 18 is Par 3, for panel 20 is Par 4 and panel 22 is Par 5. Display device 118 records and displays the panel count for each panel up to a maximum of three for each panel. Since the sensors associated with the accumulation of the total score can also be used to count the number of balls landing on each panel, no additional sensors are required for the panel count.

To illustrate the operation of panel count display device 118, in connection with the scorekeeping devices of the invention, if the first ball of a game lands on par 3 panel 18, it will be detected by any of the sensors 52, 54, 90, 92, 94, 100 and 102 which are associated with panel 18. The first ball to land on panel 18 will illuminate a first one of the three lamps in the "par 3" row of display 118, at 120. The second ball to land on panel 18 will illuminate the second lamp in the par 3 row, at 122. The third ball to land on panel 18 will illuminate the third lamp, at 124. Similarly, the first three balls to land on par 4 panel 20 will cause the three lamps in the "par 4" row on display 118 to be illuminated sequentially and the first three balls to land on par 5 panel 22 will cause the three lamps in the "par 5" row to be illuminated sequentially.

Figure 5:
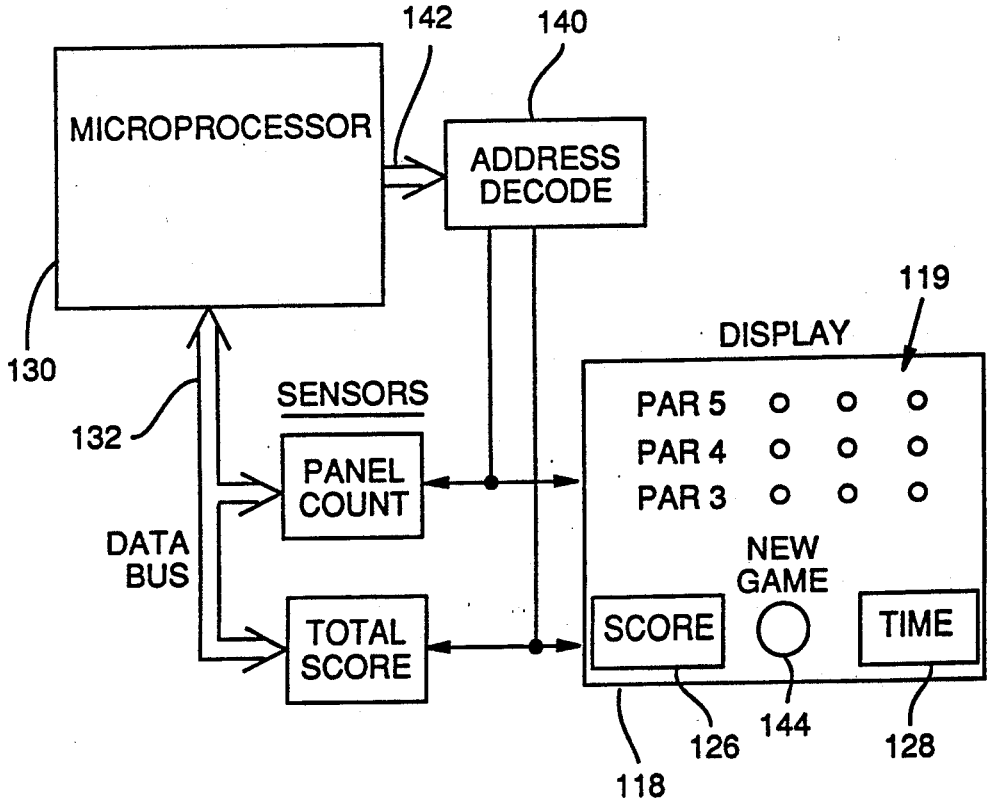
FIG. 5 is a schematic circuit diagram of the control and display circuitry used in the scorekeeping system of the present invention.

FIG. 5 provides a schematic circuit diagram of the circuitry used in scoring a golf chipping practice game played with the apparatus of the present invention. The scorekeeping device includes the sensors 52, 54, 56, 60, 62, 64, 90, 92, 94, 100 and 102 associated with each panel, and with each ball return channel, of the apparatus. Electrical signals from the sensors are transferred via multiple separate lines or by suitable encoding techniques to a microprocessor 130 which controls the scorekeeping device. The various lines carrying sensor signals to microprocessor 130 are termed data bus 132 in FIG. 5.

Microprocessor 130 can be any suitable programmable computer capable of receiving the various signals from the sensors, assigning the appropriate scoring values to the signals received, and transmitting appropriate score and panel count values to display 118. The programming software used in microprocessor 130 is a matter of design choice and is not part of the present invention. It is within the capability of those skilled in the art to enable microprocessor 130 to perform the following tasks as part of the scorekeeping function of the present invention:

Microprocessor 130 will store the predetermined scoring values assigned to the various target zones on the apparatus, as set forth in box 114 (FIG. 4). That means assigning scoring values according to the following table for chip shots landing in the eagle, birdie, par, bogey and double bogey target zones.

| | Scoring Value | | | | |
|---|---|---|---|---|---|
| | Eagle | Birdie | Par | Bogey | Dbl. Bogey |
| On the Par 3 panel: | 1 | 2 | 3 | 4 | 5 |
| On the Par 4 panel: | 2 | 3 | 4 | 5 | 6 |
| On the Par 5 panel: | 3 | 4 | 5 | 6 | 7 |

Interconnections between the various sensors on the apparatus and scorekeeping microprocessor 130 are employed by the microprocessor to determine which target zone a ball has landed in. The following sensors detect eagles: Sensor 52 on panel 18, sensor 56 on panel 20 and sensor 62 on panel 22. The following sensors detect birdies: Sensor 54 on panel 18, sensor 60 on panel 20 and sensor 64 on panel 22. The following sensors detect pars: Sensor 90 at the center of ball return channel 82 on panel 18, sensor 90 at the center of ball return channel 84 on panel 20 and sensor 90 at the center of ball return channel 86 on panel 22. The following sensors detect bogeys: Sensors 92 and 94 in ball return channel 82 on panel 18, sensors 92 and 94 in ball return channel 84 on panel 20 and sensors 92 and 94 in ball return channel 86 on panel 22. The following sensors detect double bogeys: Sensors 100 and 102 in ball return channel 82 on panel 18, sensors 100 and 102 in ball return channel 84 on panel 20 and sensors 100 and 102 in ball return channel 86 on panel 22.

Microprocessor 130 will assign correct scoring values to balls which trip several sensors. A ball landing on par 3 panel 18 above sensor 100, will trip sensors 100, 92 and 90. Microprocessor 130 will compute the score either by reading sensor 100 and blocking the subsequent signals from sensors 92 and 90 or it can detect the sequential signals from sensors 100, 92 and 90 and assign the correct double bogey score to that combination of signals.

Another function of the scorekeeping device of the apparatus is to determine the panel count displayed on panel 118. That task is accomplished by determining which panel a ball has landed on and causing the appropriate display lamp in display 119 to illuminate. Another function of the scorekeeping device is to accumulate a total score based on the addition of individual scoring values assigned to each ball as it lands in one of the target zones on the apparatus. Total score is preferably displayed in a separate box 126 on the display panel of the device.

Microprocessor 130 can also be used to perform game initialization functions such as zeroing the "total score" box 126 of the game display 118 and initializing display lamps 119. If the game incorporates a total elapsed time function or display 128, to measure the total time it takes to complete a round, that can also be controlled and reset by microprocessor 130. Separate address decoding circuitry 140, controlled by microprocessor 130 via address bus 142, controls the various displays on display device 118 using well known display generation techniques.

A golf chipping practice game played on the apparatus of the present invention will next be described. The game uses both the target zone information on which the total score is based and information about the number of balls landing in each region of the ball receiving area (the panel count) to create a unique and interesting golf chipping game. The challenge of the game is enhanced because both the total score and panel count are available for scorekeeping purposes.

The game is initialized by depressing a new game button 144 on display device 118, which can be conveniently located on a pedestal stand 46 adjacent ball hitting area 12, as shown in FIG. 1. The new game button will cause microprocessor 130 to zero or initialize all the displays on display device 118. A golfer, standing at golf hitting location 12, will place a ball on chipping pad 14 and hit the ball into the ball receiving region of the apparatus and onto one of the panels 18, 20, 22. The ball will enter one of the target zones on a panel, triggering one or more sensors thereon. A scoring value will be assigned to the shot, depending on the target zone hit, and the panel count for the panel the ball landed on will index upward by one. If the first shot of the game lands on par 3 panel 18, the first lamp 120 in the "par 3" row of display lamps 119 will illuminate. If the ball goes into eagle hole 52, the score appearing in box 126 will be one. If the ball enters birdie hole 54, the score will be two. If the ball lands in the par, bogey or double bogey zone, the score will be three, four or five, respectively.

On the next shot, the player again hits the ball onto one of the panels. Assuming the second shot lands on par 4 panel 20, the first lamp in the "par 4" row of display lamps 119 will illuminate. The scoring value for the target zone on panel 20 where the ball landed will simultaneously be added to the score appearing in box 126. Assuming the second shot lands in the par zone on par 4 panel 20, a scoring value of four will be added to the total score in box 126.

If, on the third shot, the player chips onto the double bogey target zone on par 3 panel 18, the second lamp 122 in the par 3 row of display lamps 119 will illuminate. Simultaneously, a double bogey scoring value of five will be added to the score appearing in box 126.

A player will attempt, in the fewest number of shots, to illuminate all nine lamps in the panel count display 119 of display device 118. That means a player will attempt to hit each of the panels three times. A score will accumulate or increase each time a ball lands on a panel, the amount of increase being dependent on the target zone hit. Once all the panels have been hit three times, the game is over.

Should a player accidentally hit one of the panels 18, 20, 22 more than three times, before completing a round, no additional lamps 119 are available to be lit on the display device 118. Nevertheless, the scoring value associated with the shot will be added to the total score in box 126. In that way, accuracy is encouraged because shots which inadvertently strike a panel which has already been hit three times will increase the total score without furthering the player's progress toward the end of a game. Thus, if a player has hit par 3 panel 18 three times and, par 4 panel 20 three times and par 5 panel 22 two times, that player will necessarily aim for the par 5 panel in an effort to complete the game. At that point in the game, only a chip shot landing on the par 5 panel will end the game. If a subsequent shot lands on the par 4 panel 20, additional score will accumulate in total score box 126, the score being either two, three, four, five or six depending on the target zone hit, and the player must take another shot. Until the player hits the par 5 panel 22, he must continue shooting and accumulating additional score.

Although the game described above has no maximum score, there is a minimum score achievable under the above-defined rules. A player hitting three shots into the par 3 eagle hole 52, three shots into the par 4 eagle hole 56 and three shots into the par 5 eagle hole 62 will score 18. No other combination of shots can achieve a lower score.

It is anticipated that the apparatus can be used in a competitive manner between two or more players, each attempting to complete the game by lighting all nine lamps on the display device 118 with the lowest possible score. Microprocessor 130 can be readily programmed to accommodate two or more players, retaining a separate total score and panel count for each player, up to the limits of available memory. Players could take shots alternately, with the display device 118 alternating between the total score and panel count of each player. Switches or buttons on display 118 (not shown) can be used to identify and select the player who is playing, or the system can be programmed to follow a selected player rotation pattern. It would also be possible to include separate displays 118 for each player. The player or players are able to test their chipping skill using the apparatus of the present invention by comparing the total score during and after each completed round. An individual can compete against an opponent or against himself, the goal being the completion of a round with the lowest possible total score.

Alternative embodiments of a golf chipping practice apparatus in accordance with the present invention might include additional target panels on the apparatus. While the use of three panels permits scorekeeping using regulation golf terminology such as par 3, 4 and 5, an apparatus with additional panels could readily be devised using some alternative type of scoring terminology. Similarly, fewer than three panels could be used in conjunction with the apparatus of the present invention. The number, arrangement and size of the target zones on each panel is a matter of design choice and alternatives will occur to those skilled in the art. It is not essential that the panels have identical, or nearly identical, target zone patterns. Panels can be equipped with a greater or lesser number of holes and alternative arrangements of target zones within the scope of the present invention. While the illustrative embodiment anticipates a game concluding after a maximum of three shots striking each panel, a larger or smaller maximum panel count could alternatively be used. The scoring values of the illustrative embodiment, based on regulation golf scoring terminology such as eagle, birdie and par could be dispensed with in favor of assigned number values or fractional number values, as desired. While the target panels are shown arranged generally linearly, one after another along a longitudinal axis, the panels could be positioned off the central longitudinal axis or in a staggered fashion. An additional target zone could be provided for balls which land outside the panels, on netting for example, such balls being consistent with out of bounds shots which could be assigned additional penalty strokes. A different type of scorekeeping device could be used, one which only indicates the target zone a ball lands in and relies on the player to accumulate or record the total score or the panel count. The apparatus could be coin-operated or include a built-in time limit for each game, to facilitate commercial operations.

The present invention provides a golf chipping practice apparatus which is relatively compact and suitable for indoor or outdoor use. The apparatus provides simulated chipping practice for the user. The invention provides a golf chipping practice apparatus on which a golf chipping game can be played which is both challenging and interesting. The apparatus incorporates an automated scorekeeping system which follows scorekeeping rules suitable for individual play as well as match play against an opponent.

What is claimed is:

1. A golf chipping practice apparatus for use by a player positioned in a ball hitting area, comprising:

a ball receiving area onto which balls are chipped divided into a plurality of target zones, said ball receiving area further including a plurality of regions therein each encompassing a predetermined number of said target zones, a plurality of sensors in said ball receiving area for detecting which target zone a ball lands in, and a scorekeeping device responsive to said sensors for determining the target zone a ball lands in and for simultaneously counting the number of balls landing in each said region of said ball receiving area, whereby both the target zone information and the number of balls landing in each said region are available for scoring a game.

2. A golf chipping practice apparatus as in claim 1 in which said scorekeeping device determines a score for each ball landing in said ball receiving area based on predetermined scoring values assigned to each said target zone.

3. A golf chipping practice apparatus as in claim 1 including a display device for displaying the number of balls landing in each said region of said ball receiving area up to a predetermined maximum number for each said region.

4. A golf chipping practice apparatus as in claim 1 in which a golf chipping practice game played on the apparatus is completed when a predetermined number of balls have landed in each said region of said ball receiving area, said scorekeeping device including means for accumulating a total score based on the addition of a scoring value for each ball landing in a target zone of the ball receiving area, said scoring value being predetermined for each said target zone, said scorekeeping device accumulating said total score until the completion of a golf chipping practice game.

5. A golf chipping practice apparatus as in claim 1 in which said ball receiving area includes a plurality of panels supported on a frame, each said panel being one of said regions of said ball receiving area and encompassing a plurality of said target zones therein.

6. A golf chipping practice apparatus for use by a player positioned in a ball hitting area, comprising:

a plurality of panels supported forward of the ball hitting area onto which balls are chipped, a plurality of target zones on each said panel, a plurality of sensors associated with each said panel for detecting the target zone a ball has landed in, and a scorekeeping device coupled to said sensors for determining which target zone a ball lands in and for simultaneously counting &.he number of times balls have landed on each said panel.

7. A golf chipping practice apparatus as in claim 6 including a display device for displaying a score based on the target zone balls have landed in and for displaying the number of times balls have landed on each said panel up to a predetermined maximum each said panel.

8. A golf chipping practice apparatus as in claim 6 including a ball return channel extending along at least one edge of each said panel, said panels each being inclined to direct a ball thereon into one of said ball return channels, and a plurality of said sensors at spaced intervals along each said channel, said sensors each defining a zone on the panel where balls are directed to the sensor.

9. A golf chipping practice apparatus as in claim 6 including at least three said panels arranged generally linearly one after another along a longitudinal axis, each said panel being inclined generally toward the ball hitting area, including a ball return channel for each said panel extending generally perpendicularly to said longitudinal axis along an edge of the panel closest to the ball hitting area, each said ball return channel including a plurality of said sensors therein at spaced intervals along the channel, the position of each sensor defining a target zone on the adjacent panel in the part of the panel surface which directs balls to the sensor.

10. A golf chipping practice apparatus as in claim 9 in which each said ball return channel includes at least five of said sensors defining five target zones on each said panel.

11. A golf chipping practice apparatus as in claim 9 including at least one additional target zone on each said panel in the form of a hole through the panel for receiving a ball therein, and further including a sensor for detecting a ball passing through said hole.

12. A golf chipping practice apparatus as in claim 6 wherein three said panels are provided forward of the ball hitting area, including a panel designated the Par 3 panel, a panel designated the Par 4 panel and a panel designated the Par 5 panel, and in which target zones on each said panel include an eagle zone, a birdie zone, a par zone, a bogey zone and a double bogey zone, in which said scorekeeping device generates a total score in response to the target zone each ball lands in, the total score being an accumulation of scoring values which are predetermined for each target zone in accordance with the following table:

| | Scoring Value | | | | |
|---|---|---|---|---|---|
| | Eagle | Birdie | Par | Bogey | Dbl. Bogey |
| On the Par 3 panel: | 1 | 2 | 3 | 4 | 5 |
| On the Par 4 panel: | 2 | 3 | 4 | 5 | 6 |
| On the Par 5 panel: | 3 | 4 | 5 | 6 | 7 |

13. A golf chipping practice apparatus for use by a player positioned in a ball hitting area, comprising:

a plurality of panels forward of the ball hitting area supported generally linearly one after another along a longitudinal axis, a plurality of target zones on each said panel, means for detecting which target zone a ball lands in, and scorekeeping means for determining which target zone a ball lands in and for counting the total number of times balls have landed on each said panel up to a predetermined maximum total number.

14. A golf chipping practice apparatus as in claim 13 in which said scorekeeping means generates a total score by accumulating scoring values for each ball landing in a target zone, said scoring values being predetermined for each said target zone, said scoring values being accumulated until said predetermined maximum total number of balls have landed on each said panel.

15. A golf chipping practice apparatus as in claim 13 in which each said panel is generally rectangular and inclined generally toward the ball hitting area, each said panel including a ball return channel associated therewith extending generally perpendicularly to said longitudinal axis along the panel edge closest to the ball hitting area, said means for detecting a ball landing on each said target zone including sensor means for detecting a ball located at spaced intervals along each said channel, the position of each said sensor means defining a target zone on the associated panel in the region which directs balls to the sensor means.

16. A golf chipping practice apparatus as in claim 15 including at least one additional target zone on each said panel in the form of a hole through the panel for receiving a ball therein, and further including a sensor for detecting a ball passing through said hole.

* * * * *